US005491951A

United States Patent [19]

Riegelman

[11] Patent Number: 5,491,951

[45] Date of Patent: Feb. 20, 1996

[54] COMPOSITE FRAMING MEMBER CONSTRUCTION FOR WINDOWS AND DOORS

[76] Inventor: Harry M. Riegelman, 2417 Wimbledon Dr., Arlington, Tex. 76017

[21] Appl. No.: 203,712

[22] Filed: Feb. 28, 1994

Related U.S. Application Data

[63] Continuation of Ser. No. 788,632, Nov. 6, 1991, abandoned.

[51] Int. Cl.[6] ..... E04C 1/00

[52] U.S. Cl. ..... 52/309.16; 52/656.1; 52/656.2; 52/730.1

[58] Field of Search ..... 52/309.15, 309.16, 52/475, 656.1, 656.2, 730.1, 731.1, 731.2, 732.1, 780, 727, 789; 49/DIG. 1, DIG. 2

[56] References Cited

U.S. PATENT DOCUMENTS

| | | | |
|---|---|---|---|
| 2,581,532 | 1/1952 | Hem | 52/309.16 |
| 3,470,598 | 10/1969 | Berthelsen | 52/389.16 |
| 3,703,063 | 11/1972 | Budich et al. | 52/727 |
| 3,760,544 | 9/1973 | Hawes | 52/309.16 |
| 3,767,504 | 10/1973 | Singleton | 52/309.16 |
| 3,964,231 | 6/1976 | Budich | 49/DIG. 2 X |
| 4,130,976 | 12/1978 | Kesseler | 49/DIG. 2 X |
| 4,271,634 | 6/1981 | Andrizejewski | 49/491 |
| 4,341,831 | 7/1982 | Kleiss | 52/309.16 |
| 4,492,063 | 1/1985 | Schock | 49/DIG. 2 X |
| 4,569,154 | 2/1986 | Bayer | 49/504 |
| 4,640,054 | 2/1987 | Breimeier et al. | 49/504 |
| 4,689,933 | 9/1987 | Biro | 52/475 X |
| 4,715,153 | 12/1987 | Rohrman | 52/213 |
| 4,776,556 | 10/1988 | Dingler | 52/309.16 |
| 4,974,366 | 12/1990 | Tizzoni | 49/504 |
| 4,977,722 | 12/1990 | Taylor | 52/656.2 |

OTHER PUBLICATIONS

The Design Engineer's Guide to Polymer/Metal Composites, Nov. 1986, by Kingston–Warren Co. Newfields, NH 03856.

*Primary Examiner*—Carl D. Friedman
*Assistant Examiner*—Beth Aubrey
*Attorney, Agent, or Firm*—Robert A. Seemann

[57] ABSTRACT

A unitary composite frame member of two or more structural elements. A first and a second of the elements each contributes strength to the member. The second element which is preferably a plastic, has a conductivity not exceeding 5% of that of the first element, and covers the first element, contributing to the shape of the frame member. Preferably each of the two elements is strong enough to retain its shape without aid from the other element, and the second element contributes at least 10% of the structural strength of the member. The elements are molded together, with the covering element in a plurality of similarly shaped openings in the element that it covers.

5 Claims, 17 Drawing Sheets

FIG. 18

COMPOSITE FRAMING MEMBER CONSTRUCTION FOR WINDOWS AND DOORS

This application is a continuation of application Ser. No. 07/788,632, filed Nov. 6, 1991, now abandoned.

BACKGROUND OF THE INVENTION

1. Field of the Invention

The present invention relates in general to composite framing for building closures, more specifically to framing construction of low thermal transmittance, high strength, and low cost.

2. Description of the Prior Art

Most present day framing members for windows and doors are fabricated from finite lengths of a single material, mainly extruded aluminum, extruded plastic, or wood millwork.

Extruded aluminum offers stiffness and strength, low cost and low maintenance, but has high thermal conductivity. Extruded plastic offers low thermal conductivity, low maintenance and moderate cost, but does not have the stiffness and strength of aluminum. Wood millwork offers low thermal conductivity and reasonable structural qualities, but is higher in cost and requires considerable maintenance.

Preferably a framing member should be a composite of two or more materials, for example, metal and plastic, integrating the best characteristics from each material.

Framing construction art is replete with composite element designs incorporating metals and plastics.

Budich et al. in U.S. Pat. No. 3,703,063, patented Nov. 21, 1972, describes a profile element or windows or doors, comprising a hollow closed metal section surrounded by a shell of plastic for resistance to corrosion and for heat insulation.

He teaches that art prior to his invention includes a great variety of designs having a common disadvantage. It is that the number of basic profiles required for window and door facade assembly is relatively large and that numerous auxiliary profiles are necessary for combining these basic profiles into a flawless, tight connection to the structural component. The Budich profile overcomes this by providing a plurality of projections of-the plastic shell with each projection being for a different application such as a saw-tooth projection for contact with glazing, anchoring means for securing the metal portion to a fixed structure in the form of connecting projections of first and second legs extending in parallel relationship with transverse end portions directed toward each other, and an abutment projection of special shape, for attachment to another Budich profile, so that the profile member has a generally more universally adaptable configuration.

Depending upon their shapes, the projections may be manufactured integrally with the plastic shell, or independently thereof, in which the latter case they are joined to the shell subsequently, for example, by cementing or welding.

U.S. Pat. No. 4,271,634 patented Jun. 9, 1981 by H. Andrzejewski, discloses a metal carrier for channel-shaped sealing, trimming or finishing strip for a channel-shaped window glass guide such as used in automobile window or door openings which resists and limits stretching. It comprises a series of U-shaped metal elements arranged in side-by-side and spaced apart relationship so as to define a channel.

The elements are connected to one another alternately in series by only a link between the apex of the U, or by a pair of links between the legs, one link being on each side of the U.

Each of the legs connected by a link, further includes an extension adjacent to its distal end. The extension terminates in an abutment face that is adjacent to the abutment face of the corresponding connected leg.

The carrier is covered by flexible plastic in which are imbedded the elements, legs, links and abutments. Manufacture is suggested to be by cutting slots in a metal blank by stamping or pressing, then rolling the blank longitudinally in to a U-shape, and after manufacturing the blank, feed the blank into a cross-head extruder so as to cover it with the extruded plastic or rubber.

A tubular seal on one side of the U, along the length of the carrier may be included integrally with the covering, or may be secured to it by some means. In either case it need not be of the same hardness as the carrier covering.

The alternate links permit the carrier to flex during installation, while the abutting extensions prevent or limit stretching of the strip so that it will resile quickly at the time of installation of the strip to a body, for a better and more secure fit.

U.S. Pat. No. 4,569,154 patented by M. Bayer on Feb. 11, 1986, discloses a metal and plastic composite type construction for window framing which, instead of plastic coating over metal, consists of an inside facing plastic extrusion member joined by interconnecting interlocking barbs, darts or arrows to a generally parallel outside facing metal extrusion member. One member is more rigid than the one to which it is joined, and one member has lower thermal conductivity than the one to which it is joined. The shape of the barbs is important to a success of providing a positive lock function for securing the parts together to provide thermal insulation coupled with window strength.

U.S. Pat. No. 4,640,054, patented Feb. 3, 1987 by Breimeier et al., describes a frame for windows or doors which consists of two plastic covered, hollow metal sections, joined by the plastic of their coverings. One section is exposed to the outside environment, the other to the inside environment.

This is different from the art in which a single, plastic covered hollow metal section is exposed to the inside environment on one side, and the outside environment on the other side.

In Breimer's invention, the plastic that is covering and joining the two sections provides thermal insulation. The arrangement permits the two thermally separated hollow aluminum sections to assume different temperatures whereby their elongations and shrinkages have less affect on the neighboring plastic than other designs in the art.

U.S. Pat. No. 4,715,153, patented Dec. 29, 1987 by H. Rohrman, discloses a universal building panel structural frame member which may be used as a head member, side jamb member, sill member, vertical mullion, and horizontal transom member, to form those structures without a need for members of different design, and brackets, plates and bolts to join them.

The invention comprises a unitary elongate roll-formed element that can be cut to length to provide structural members for the above purposes. The element is J-shaped in cross-section, having a flat elongate intermediate plate member, a head on one side of the plate member having portions laterally extending outwardly in opposite directions from the plate member, and a foot member on the opposite side of the plate member laterally extending therefrom. A pair of opposed elongate lips also extend from the plate member.

A preferred embodiment comprises a steel J-shaped member coated with an elastomeric or other thermally insulating coating. The steel adds structural strength without adding bulk. The coating provides thermal insulation without reducing the structural strength of the curtain wall members.

U.S. Pat. No. 4,974,366, patented Dec. 4, 1990 by S. Tizzoni, describes a frame construction for a door opening. The frame includes a reinforced, insulated jamb member which comprises an elongated metal U-shaped channel with one leg being toward the inside environment, and the other leg being toward the outside environment.

The elongated open front end of the channel is closed by a vinyl cover thereby defining with the channel an elongated cavity. An insulating foam is injected into the cavity. After the foam hardens into a rigid and strong insulating core, the back of the U-shaped channel is sawed through lengthwise to establish a metal free insulating space between the legs of the channel.

The rigidity of the jamb is assured by the hardened insulating material between the legs. Retention of the insulating material by the legs is aided by surface grip characteristic of the Isolok TM polyurethane based rigid foam and by flanges along the length of the legs which project into the cavity.

The insulating foam is dense enough to hold hinge screws driven through the vinyl cover and into the foam, and rigid enough to withstand flexion forces exerted by weight of a door on the screws.

SUMMARY OF THE INVENTION

It is one object of the invention to provide a unitary composite frame member, of two or more materials, which has high structural strength, low thermal transmittance and low cost.

It is another object of the invention to provide an inexpensive unitary composite framing member of high structural strength and low thermal transmittance, which can be constructed by forming a first material, and covering it by a second material.

It is another object of the invention to provide the above unitary composite member in which the first material is of high strength, and the second material is of moderate strength but significantly lower thermal conductivity than the first material.

It is still another object to provide the above unitary composite member in which the second material is mechanically bonded to the first material to obtain maximum combined strength and to resist forces of differential thermal expansion.

It is still another object to provide the above unitary composite member in which the first material has portions removed in such a manner as to substantially restrict thermal flow through the material but not significantly reduce its structural strength.

In accordance with the invention a frame member of predetermined shape includes a first element that is structural in nature for contributing structural strength to the member. It is substantially non-hollow in transverse cross-section .

A second rigid element of the frame member comprises the shape of the frame member. It encloses the first element along its length in a composite, unitary molding.

If desired, the second element may cover the first element, to the extent that the shape of the frame member is expressed by the second element.

The first element may be made from a material which has high thermal conductivity.

Preferably, the first element is made with metal, and the second element is made with plastic, each of the elements being strong enough to retain its shape without aid from the other element.

The type of plastic and thickness of the second element is chosen for the second element to contribute to the strength of the member, and to be of significantly lower thermal conductivity than the first element.

Preferably, the second element contributes at least 10% of the total structural strength of the entire member and has a thermal conductivity not exceeding 5%, and preferably not exceeding 1% of that of the first element.

The two elements are molded together with a mechanical grip that maximizes the combined strength of the two elements and resists differential expansion, by molding the second element in a plurality of similarly shaped openings in the first element thereby restricting slippage and detrimental effects from difference in thermal expansion between the two elements. The shapes of the openings include rectangular, angular, circular and mesh.

A method for making the composite frame member of predetermined shape includes forming a metal strip into a U-channel, passing the U-channel through a plastic extruder for coating the steel strip with plastic in a thickness that increases the strength of the member, and sawing through the coating and U-channel between the legs of the U-channel, for substantially reducing thermal transmittance of the frame.

BRIEF DESCRIPTION OF THE DRAWINGS

In order that the invention be more fully comprehended, it will now be described, by way of example, with reference to the accompanying drawings, in which:

FIG. 1 is an all aluminum frame according to prior art.

FIG. 2 is a thermally broken "TB aluminum", aluminum frame according to prior art.

FIG. 3 is an all vinyl frame according to prior art.

FIG. 4 is an all wood frame according to prior art.

FIGS. 5–11 are composite constructions according to the present invention. These examples are made from vinyl and steel in various configurations for comparison of their relative strength, cost and thermal transmittance values.

FIG. 12 is a perspective view of a high bond, high strength composite frame of low thermal transmittance and cost.

FIG. 13 is a perspective view of another high bond composite frame of low thermal transmittance and cost.

FIG. 14 is a perspective view of a high bond, high strength, composite frame of low thermal transmittance and cost.

FIG. 15 is a perspective view of a high bond, high strength frame of low thermal transmittance and cost.

FIG. 16 is a perspective view of a high bond, high strength frame of low thermal transmittance and cost.

FIG. 17 is a perspective view of manufacturing stages of a high bond, high strength frame of low thermal transmittance and cost.

FIG. 18 is a perspective view of a box-beam composite construction.

FIG. 19 is a perspective view of an H-beam composite construction.

FIGS. 20 and 21 are sliding glass door assemblies incorporating the variations of the frames shown in FIGS. 5–19.

DESCRIPTION OF THE PREFERRED EMBODIMENTS

Figure 1:
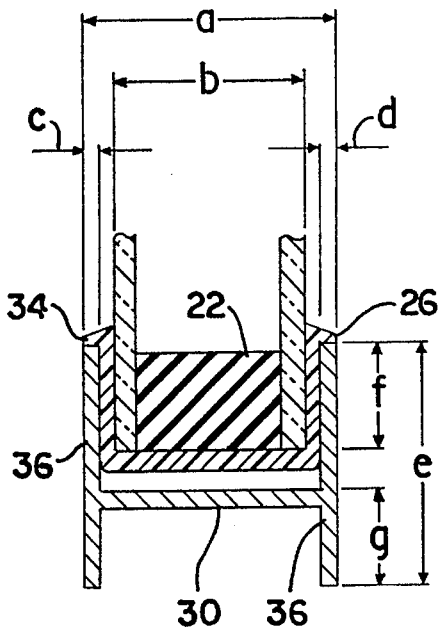
FIG. 1 PRIOR ART
FIGS. 1–11 are cross section diagrammatic views of window frames for comparison of strength, cost and thermal transmittance.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

A frame constructed according to the present invention includes at least two structurally strong materials, one having substantially lower thermal conductivity properties. More specifically, the frame includes an inflexible member comprising a composite of at least two inflexible, structurally strong elements, each being of an inflexible, structurally strong material. A second of the materials has substantially lower thermal conductivity properties than the first material. The element formed of the first material has a plurality of openings through a wall of the element. The second element encloses the first element on essentially all surfaces of the first element, and is molded to itself from the front to the back of the wall through the plurality of openings.

Relative strength, cost and thermal transmittance values for Prior Art FIGS. 1–4 and present invention FIGS. 5–11 extrapolated from concentrated load deflection analysis on three baseline specimens are provided in chart A which follows the Concentrated Load Deflection Analysis Report, infra. FIGS. 1–11 typify constructions for windows and sliding glass doors. Comparing performance of prior art in FIGS. 1–4 with composites of the present invention as in FIGS. 5–11. there is shown in cross section an all aluminum frame, FIG. 1, a thermally broken "TB" aluminum frame, FIG. 2, an all plastic frame with hollow legs and base, FIG. 3, and a solid wood frame, FIG. 4.

In the figures, window pane 22 held by locating strip 26 rests in channel 30, supported by shoulders 34 on forward channel legs 36.

Figure 3:
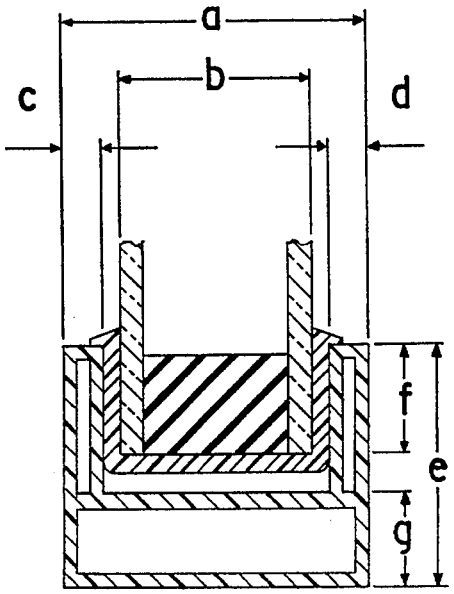
FIG. 3 PRIOR ART
Figure 4:
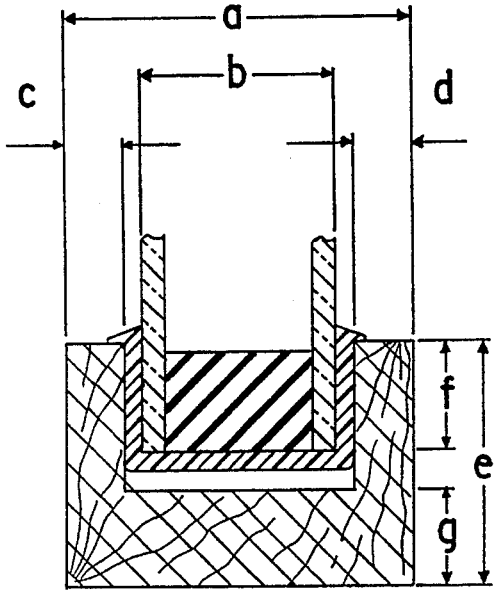
FIG. 4 PRIOR ART
Figure 9:
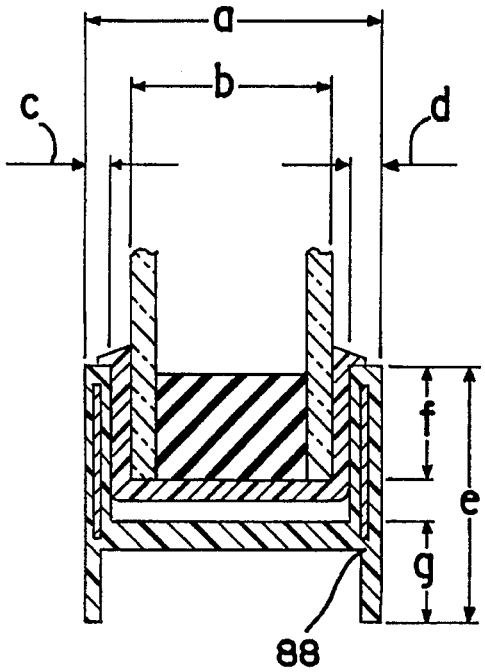
Figure 10:
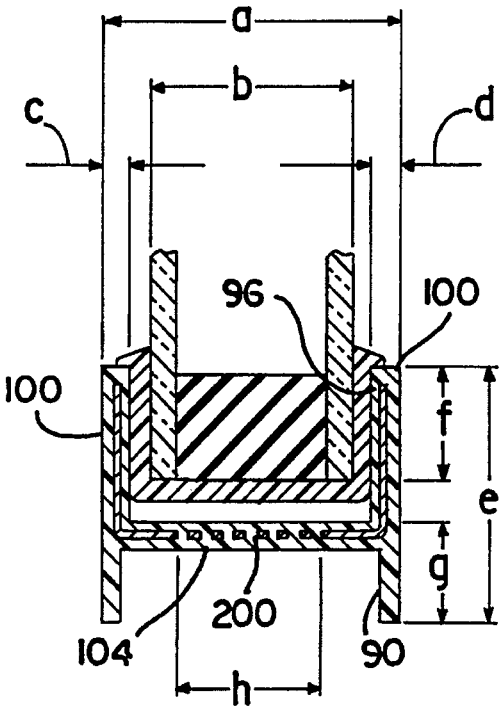
Figure 11:
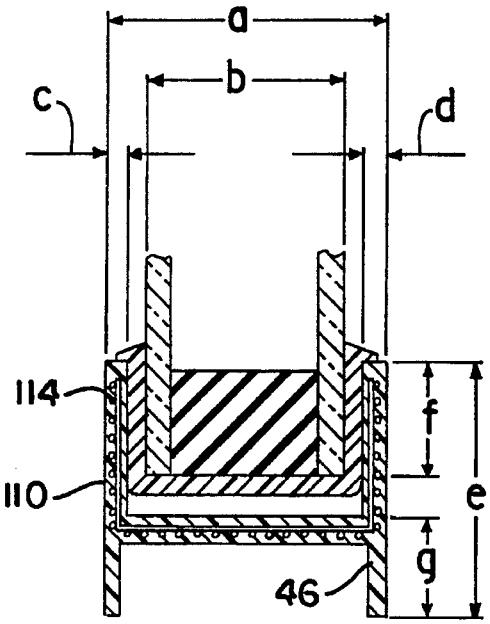

In FIGS. 3, and 5–11 the plastic is vinyl. In FIGS. 5–10, the structural steel is 0.5 millimeters thick. In FIG. 11, the steel is 0.25 millimeters mesh. In FIG. 3, the vinyl is 2 millimeters thick. Reference dimensions for the FIGS. are given in Chart A. They are provided for purpose of example, and should not be construed as limitations upon actual construction.

According to accepted industry practices, flexible vinyl such as used for thermal insulation and corrosion resistance in present window and door assemblies ranges in hardness from a Shore value of AS0 to A100.

Conversely, the hardness of vinyls of the type suitable for the present invention is measured on much higher hardness scales which range from Shore C68 to D85. It is this hardness range from which the plastic must be selected for the composite according to the present invention. Plastic for the present invention in the range of Shore C68 to D85 is termed by this inventor to be "rigid", "stiff", "inflexible". It resists change of form, resists the action of a bending force to the extent provided by the hardness range of Shore 68 to D85.

The Shore hardness of the PVC material used in the tested prototype specimens was 80 on the D scale.

The steel in the prototype test specimens was 24 gauge (0.024" thick) cold rolled steel.

Figure 22:
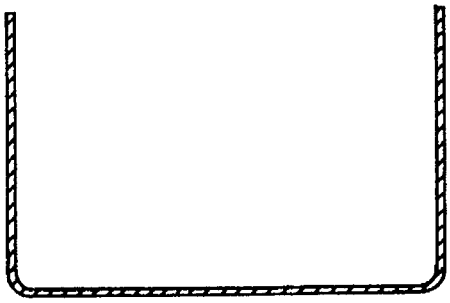
FIGS. 22, 23, and 24, show test specimens in cross section, used in a concentrated load deflection test and a thermal conductivity test.
Figure 23:
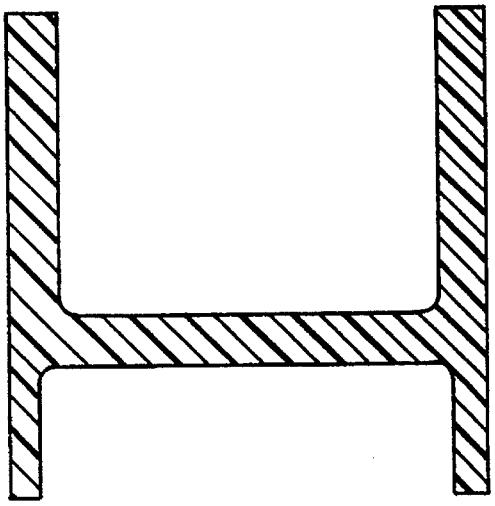
Figure 24:
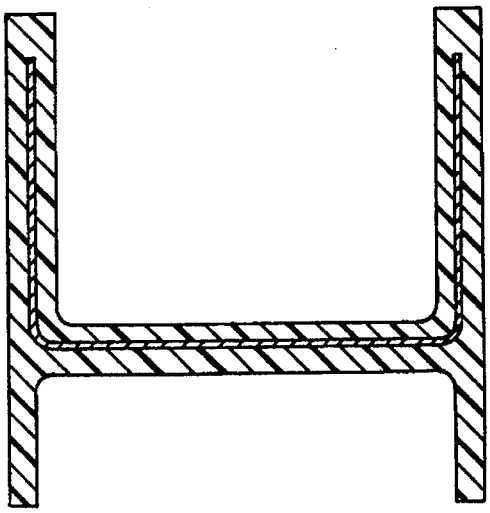
Figure 25:
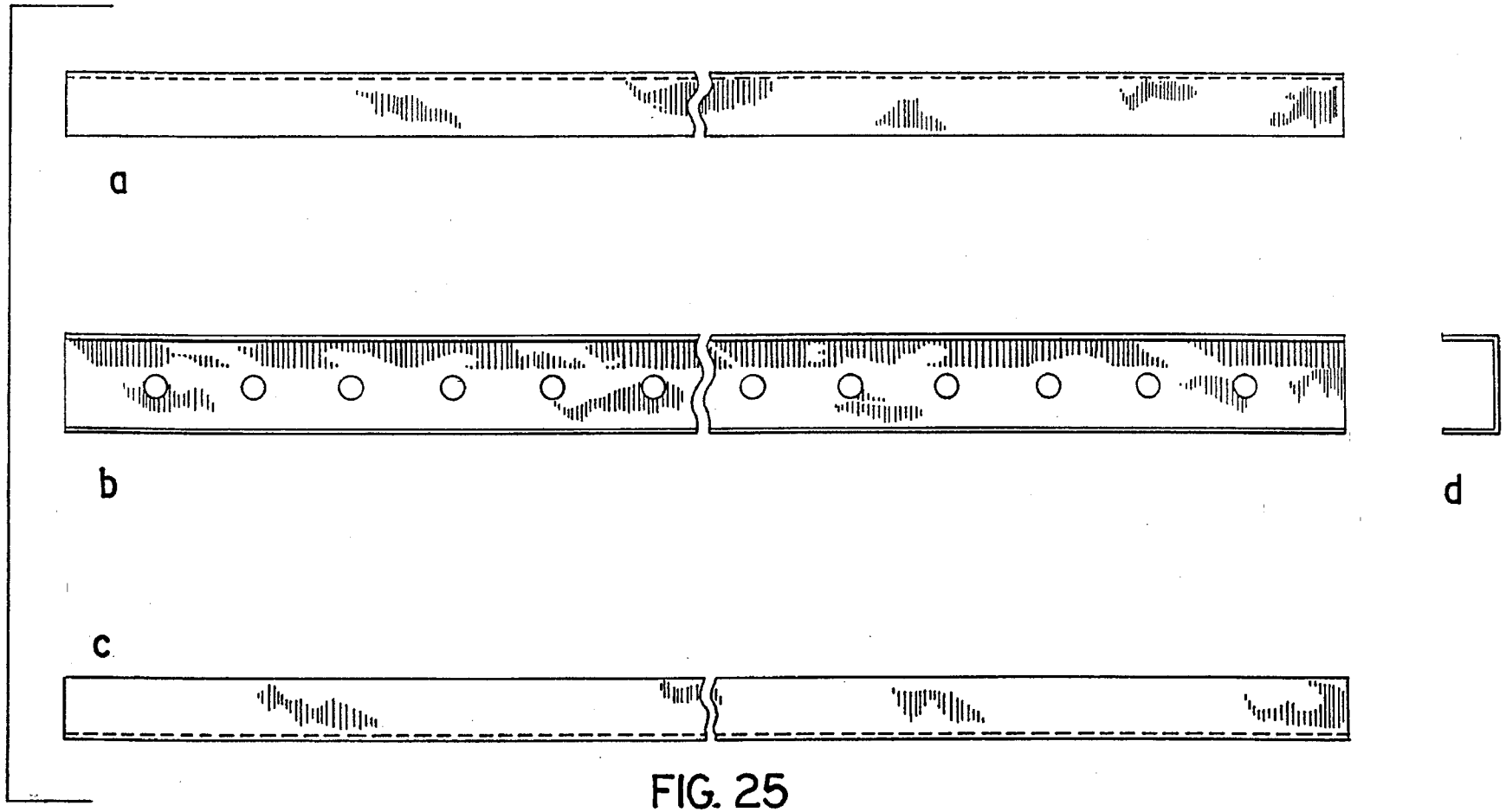
FIGS. 25, 26 and 27, show configurations applied variously to test specimens shown in FIGS. 22, 23, and 24.
Figure 26:
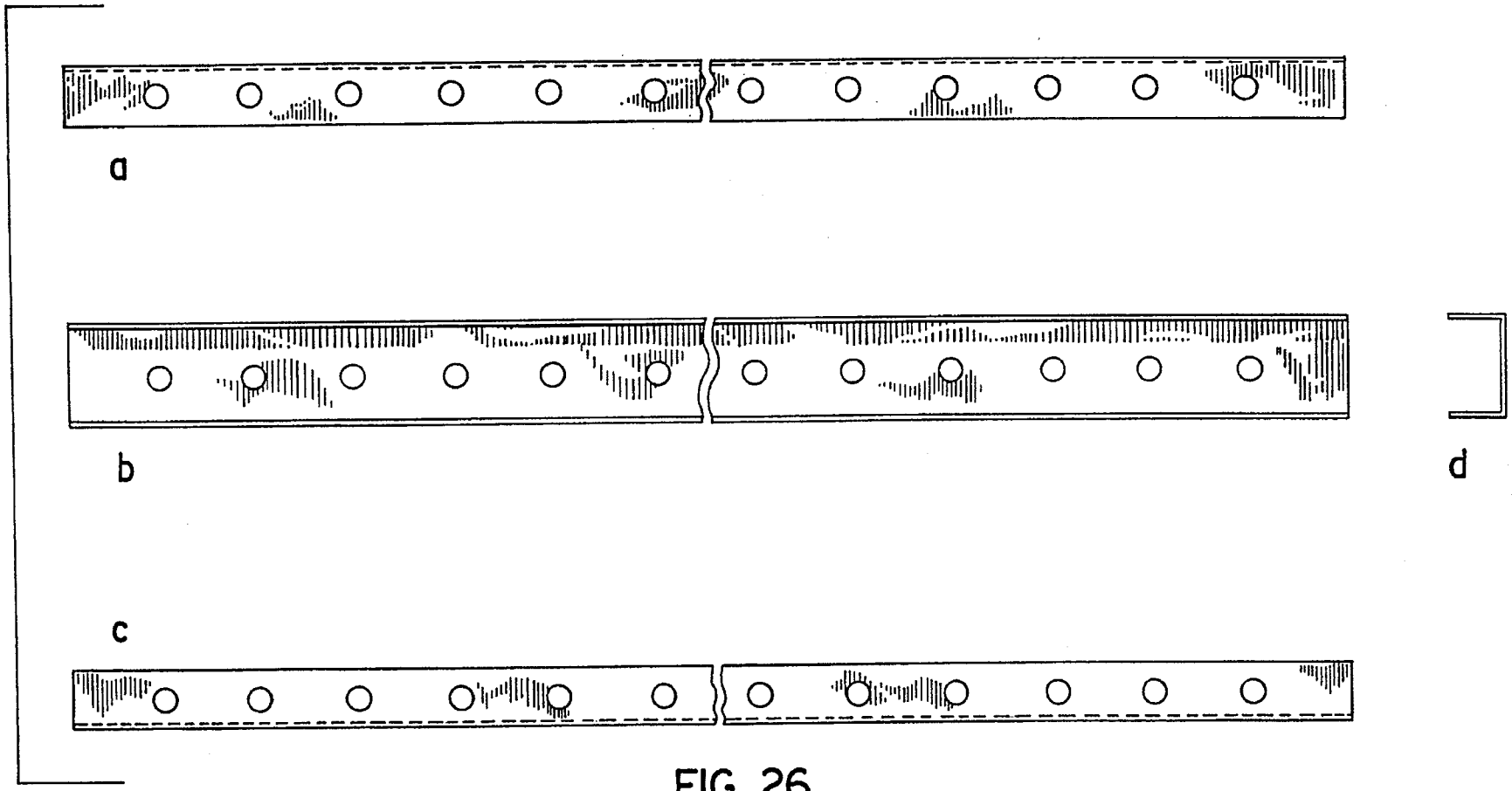
Figure 27:
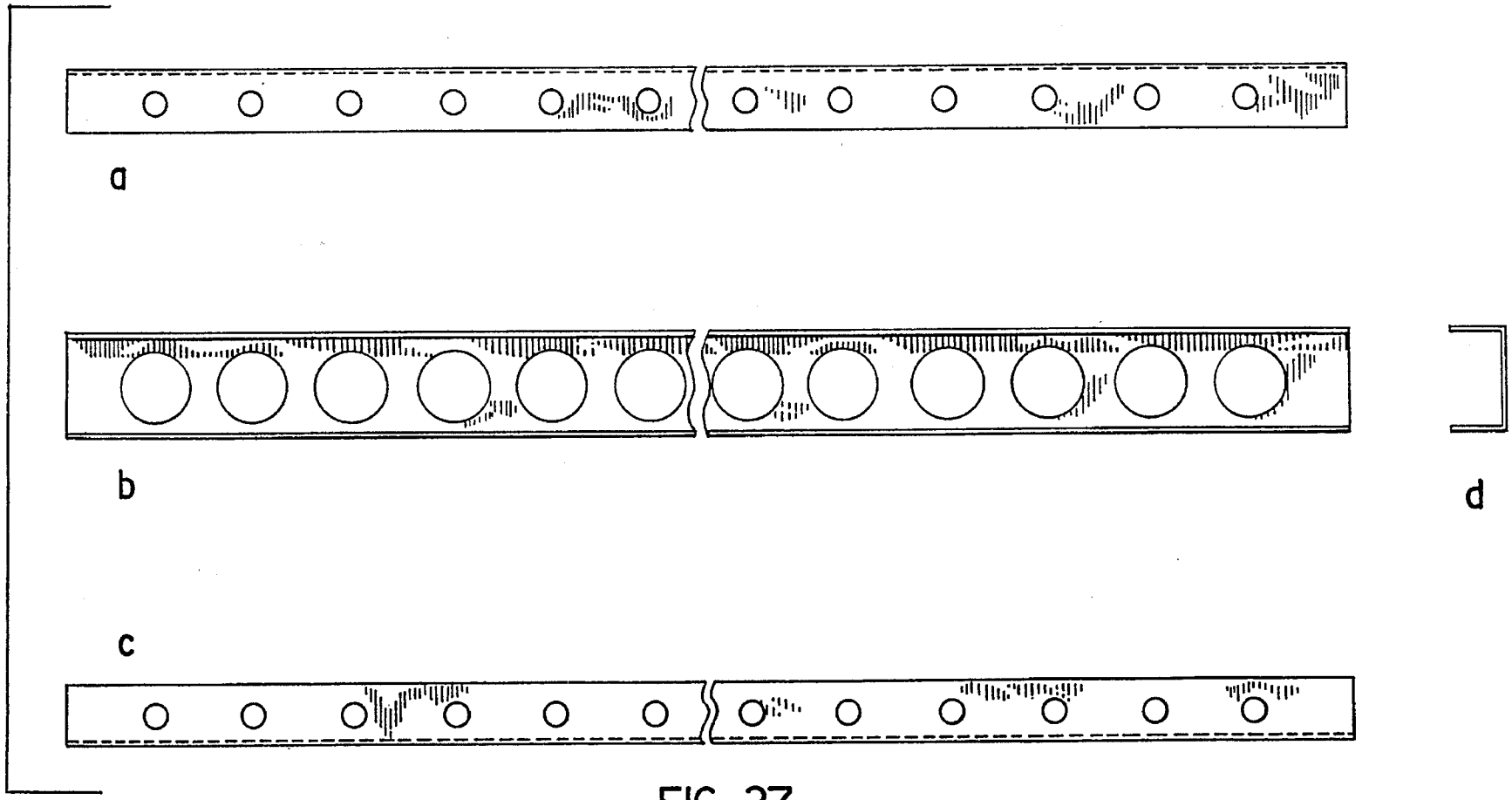
Figure 28:
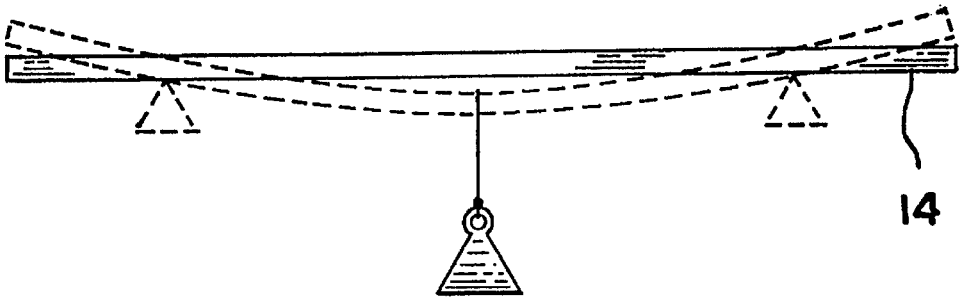
FIG. 28 shows the set up used for a concentrated load deflection test.

Concentrated Load Deflection Analysis:

This analysis shows actual results of deflection tests on the setup shown in FIG. 28 on prototype specimens in cross section of Specimens A, B, and C, shown in FIGS. 22, 23, and 24 respectively, as modified by the configurations shown in FIGS. 25, 26, and 27 respectively, which show hole configurations through walls of the specimens as viewed from the top, a; bottom, b; front, c; and right side, d.

The testing was conducted by Southwestern Testing Laboratories, 220 Gravel Drive, Fort Worth, Tex. 76118, on or about Mar. 30, 1992, which also conducted the differential thermal expansion testing and thermal conductivity testing on prototype specimens, discussed infra.

The concentrated load deflection analysis shows that the actual deflections are 10 to 18 percent below the theoretically computed deflection of each element taken separately. This inventor believes that much of this advantage is attributed to the mechanical joining of the PVC to the steel through the holes in the steel. The two rigid (stiff, inflexible) materials thus bound together act as one single load-bearing construction member. This also limits differential thermal expansion and contraction between the steel and plastic, and offers a low-cost, strong, structural member with low thermal conductivity.

FIG. 28 shows a set up for a concentrated load deflection test on a specimen 14.

Columns:
(a) - Average Actual Test Deflection, in inches
(b) - Effective Moment of Inertia, in pounds per square inch
(c) - Computed Deflection, in inches

| | (a) | (b) | (c) |
|---|---|---|---|
| Specimen (FIG. 22) | | | |
| 1. Holes in web, configuration FIG. 25 | .0605 | .00440 | |
| 2. Holes in all legs, Config. FIG. 26 | .0705 | .00377 | |
| 3. Large Web Holes, Config. FIG. 27 | .0965 | .00276 | |
| Specimen (FIG. 23) | .4075 | .04404 | |
| Specimen (FIG. 24) | | | |
| 1. Holes in web, Config. 25 | .0480 | | .0535 |
| 2. Holes in all legs, Config. 26 | .0515 | | .0613 |
| 3. Large Web Holes, Config. 27 | .0655 | | .0799 |

The formulas for the calculations were:

Effective moment of inertia:

$I=PxL^3/(48xExD)$, where

I=Effective moment of inertia,

P=Load=5 pounds

L=Span=42 inches

| | |
|---|---|
| E = | Modulus of Elasticity |
| = | 29,000,000 pounds per square inch for steel |
| = | 430,000 pounds per square inch for the PVC |

D=Actual test deflection

Computed deflection:

$D=PxL^3/[(48xExI)steel+Kx(48xExI)plastic]$, where

K=I(Exhibit C theoretical, PVC portion only)/I(Specimen per FIG. 23 theoretical)=0.874

The differential thermal expansion test:

The present invention reduces the effect of thermal differential expansion and contraction between the frame construction elements to a minimum. This permits lower construction cost due to greater design freedom with fewer provisions to accommodate temperature changes.

The coefficient of expansion for steel is 0.000006 in./in./degree F. The coefficient of expansion for PVC is about 0.000036 in./in./degree F.

The normal differential expansion in separate 48" lengths of each element over a range of 140 degrees F. is 0.202". This amount cannot be tolerated on window and door design.

The repetition of holes placed in the steel relatively close together continuously anchors the PVC to the steel. The slight differential expansion and contraction of the material, about 0.004", between the holes is safely absorbed as tension or compression within the PVC. The composite then acts as a single unit with no visibly noticeable deformation or differential expansion and contraction over a temperature range anticipated for its application.

Three 48" test specimens of a composite member according to specimen FIG. 24, having holes according to FIGS. 25, 26, and 27 were allowed to soak at 140 degrees F. for two hours to observe any sign of differential expansion or contraction between the vinyl and steel. No sign was observed.

The same specimens were then allowed to soak at 0 degrees F. for two hours to observe any sign of differential expansion or contraction between the vinyl and steel. No sign was observed.

Figure 29:
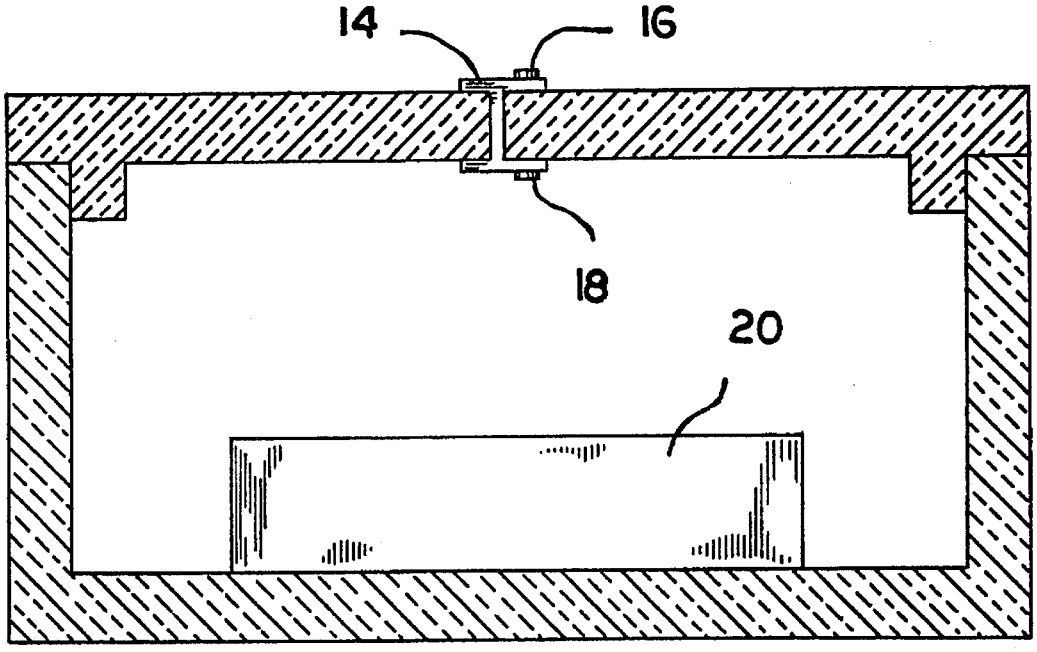
FIG. 29 shows the set up used for a thermal conductivity test.

The thermal conductivity test:

The test was made on prototype specimens according to the setup shown in FIG. 29. The specimen 14 is mounted through a wall of an insulated housing containing dry ice 20, and is monitored with warm side (room) temperature sensor 16 and cold side temperature sensor 18.

After the surface temperatures of the specimen on the cold side and warm side stabilize, the temperatures are recorded. The difference between these surface temperatures provide comparative thermal conductivities. A lower difference indicates higher thermal conductance, and greater difference indicates lower thermal conductance.

The differential temperatures listed below, recorded from the test support the calculated relative transmittance values listed in Chart "A".

Column:
I = Temperature differential in degrees F.
II = The FIG. number corresponding to the item tested
III = Relative thermal transmittance

Figure 2:
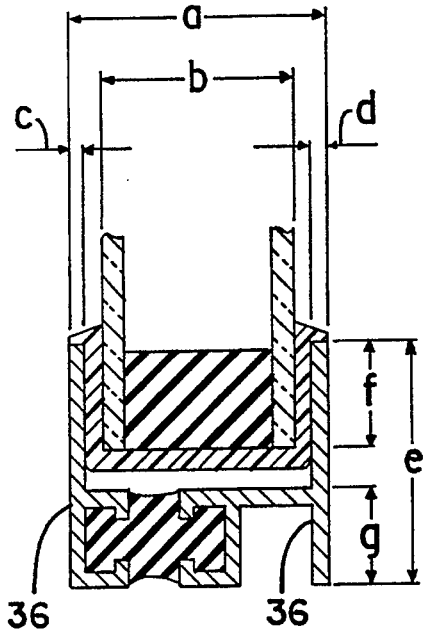
FIG. 2 PRIOR ART
Figure 5:
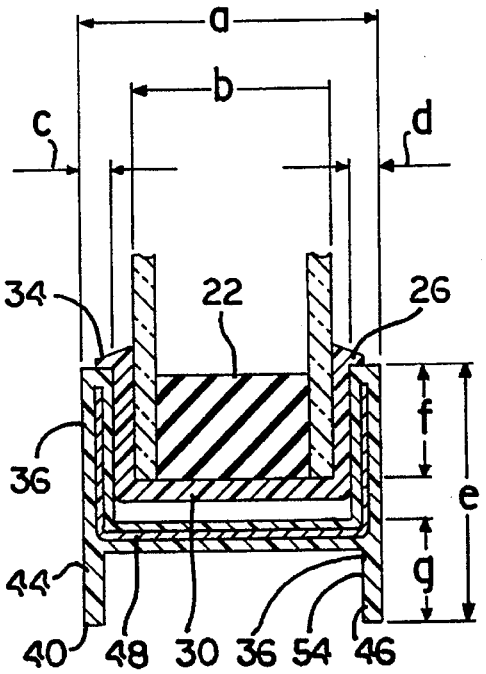

| Specimen | I | II | III |
|---|---|---|---|
| Solid aluminum | 3.2 | FIG. 1 | 100 |
| Aluminum with thermal-break | 31.1 | FIG. 2 | 68 |
| Solid Plastic (PVC) | 38.5 | FIG. 3 | 49 |
| Composites: | | | |
| FIG. 24 + FIG. 25 | 30.7 | FIG. 5 | 67 |
| FIG. 24 + FIG. 26 | 31.9 | FIG. 5 | 67 |
| FIG. 24 + FIG. 27 | 34.0 | FIG. 5 | 67 |

As the following chart "A" shows, the present invention provides a frame member of higher strength and lower thermal transmittance with the ability to be produced at a cost that is lower than prior art members.

CHART A

| FIGURE | | DIMENSIONS IN MILLIMETERS | | | | | | | | RELATIVE | RELATIVE | RELATIVE THERMAL TRANS- |
|---|---|---|---|---|---|---|---|---|---|---|---|---|
| NO. | DESCRIPTION | a | b | c | d | e | f | g | h | STRENGTH | COST | MITTANCE |
| 1 | ALUMINUM | 26.5 | 20.0 | 1.25 | 1.25 | 27.0 | 13.0 | 11.0 | | 100 | 20 | 100 |
| 2 | TB ALUMINUM | 26.5 | 20.0 | 1.25 | 1.25 | 27.0 | 13.0 | 11.0 | 6.0 | 96 | 49 | 68 |
| 3 | VINYL | 36.0 | 20.0 | 6.00 | 6.00 | 27.0 | 13.0 | 11.0 | | 19 | 44 | 49 |
| 4 | WOOD | 36.0 | 20.0 | 6.00 | 6.00 | 27.0 | 13.0 | 11.0 | | 98 | 100 | 46 |
| 5 | COMPOSITE | 29.0 | 20.0 | 2.50 | 2.50 | 27.0 | 13.0 | 11.0 | 6.0 | 99 | 24 | 67 |
| 6 | COMPOSITE | 29.0 | 20.0 | 2.50 | 2.50 | 27.0 | 13.0 | 11.0 | | 56 | 23 | 51 |
| 7 | COMPOSITE | 29.0 | 20.0 | 2.50 | 2.50 | 27.0 | 13.0 | 11.0 | 5.0 | 94 | 24 | 57 |
| 8 | COMPOSITE | 29.0 | 20.0 | 2.50 | 2,50 | 27.0 | 13.0 | 11.0 | | 99 | 36 | 56 |
| 9 | COMPOSITE | 29.0 | 20.0 | 2.50 | 2.50 | 27.0 | 13.0 | 11.0 | 14.0 | 81 | 23 | 52 |
| 10 | COMPOSITE | 29.0 | 20.0 | 2.50 | 2.50 | 27.0 | 13.0 | 11.0 | | 94 | 24 | 62 |
| 11 | COMPOSITE | 29.0 | 20.0 | 2.50 | 2.50 | 27.0 | 13.0 | 11.0 | | 33 | 23 | 60 |

Referring to FIG. 5, frame 40 which is constructed according to the invention includes structurally strong plastic 46 which covers structural steel U-channel element 48 to a thickness that insulates and adds strength to the frame. This is different from the common relatively soft or thin plastic coatings or laminations provided for insulation and corrosion resistance.

Preferably the plastic is rigid, uniformly dense, and capable of retaining its shape as recognizable at rest without aid from the metal.

Rearward depending legs 54 are made of the same structurally strong plastic. They resist twisting and bending forces on the frame without substantially adding weight or thermally receptive surface area.

Preferably, the relationship of plastic to metal in a unitary construction according to the invention is such that the plastic provides at least 10% of the structural strength of the entire item and the thermal conductivity of the plastic does not exceed 1% of that of the metal.

The following chart, derived from the concentrated load test data, shows that the plastic portion of the composite shape provides at least 10% of the strength of the total composite.

| Specimen | I | II | III = II/I |
|---|---|---|---|
| Steel: | | | |
| FIG. 25 | 0.0605 | | |
| FIG. 26 | 0.0705 | | |
| FIG. 27 | 0.0965 | | |
| Composite: | | | |
| FIG. 24 + FIG. 25 | 0.0480 | 0.0125 | 26% |
| FIG. 24 + FIG. 26 | 0.0515 | 0.0190 | 37% |
| FIG. 24 + FIG. 27 | 0.0655 | 0.0310 | 47% |

Where;

I=Actual test deflection in inches.

II=Deflection difference between steel element and total composite attributed to the plastic portion.

III=The Calculated % of the strength attributed to the plastic, i.e. the ratio of deflection difference to deflection of total composite.

The following thermal conductivity list of various materials shows that vinyl has less than 1% of the conductivity that of aluminum or steel.

| | |
|---|---|
| Aluminum | 1109.36 BTU-in./hr.-sq. ft.-degree F. |
| Steel | 332.81 BTU-in./hr.-sq. ft.-degree F. |
| Vinyl | 1.18 BTU-in./hr.-sq. ft.-degree F. |
| Vinyl = | .106% of aluminum and .355% of steel. |

Preferably the ratio of the composite elements in type and arrangement is selected so that thermal transmittance of the total composite shape does not exceed 70% of the conductivity of the metal element.

The following chart derived from the thermal conductivity test data shows that the thermal transmittance of the total composite shape does not exceed 70% of the transmittance of the metal element.

| Specimen | I | II | III | IV |
|---|---|---|---|---|
| Steel: | | | | |
| FIG. 25 | 32.5 | 5.1 | 27.4 | |
| FIG. 26 | 31.8 | 9.0 | 22.8 | |
| FIG. 27 | 30.6 | 11.6 | 19.0 | |
| Composite: | | | | |
| FIG. 24 + FIG. 25 | 41.8 | 30.7 | 11.1 | 41% |
| FIG. 24 + FIG. 26 | 42.0 | 31.9 | 10.1 | 44% |
| FIG. 24 + FIG. 27 | 43.7 | 34.0 | 9.7 | 51% |

Where;

I=Temperature span, that is the room temperature less the cold side temperature, in degrees F.

II=Differential temperature, that is the warm side temperature less the cold side temperature, in degrees F.

III=Thermal transmittance, or (I less II) in degrees F.

IV=Ratio of thermal transmittance of the total composite shape to that of the steel portion.

The above also shows that the thermal flow can be reduced by controlling the size, shape and spacing of the holes.

Figure 6:
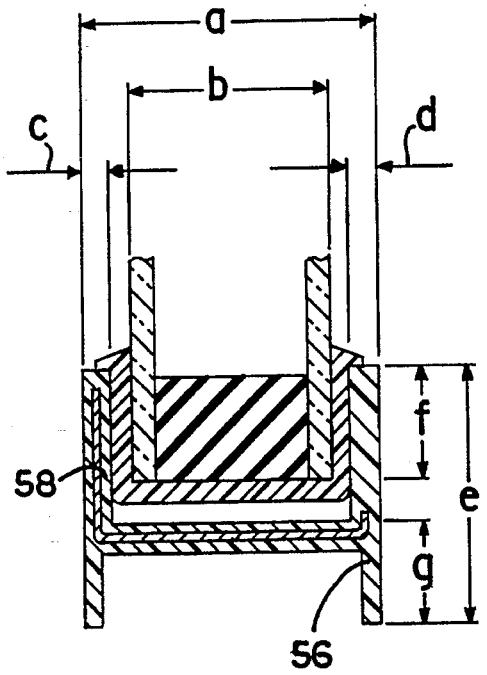

FIG. 6 shows a frame 56 which is similar to FIG. 5 except that one leg of the steel U-channel element 58 is shorter than the other.

Figure 7:
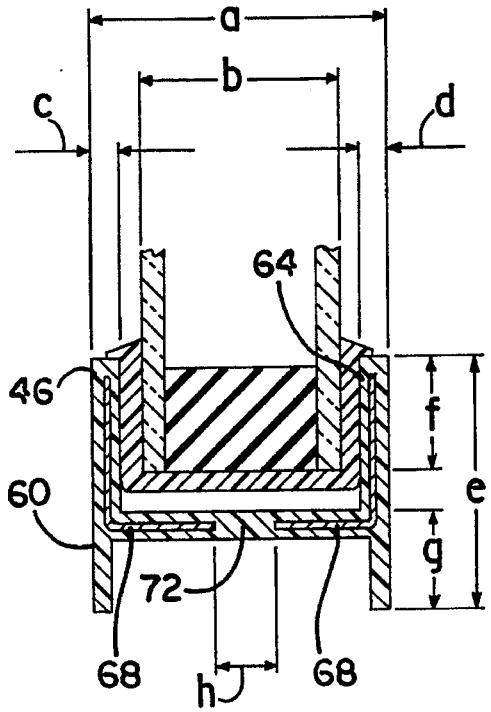

In FIG. 7, frame 60 includes U-channel 64 comprising parallel L-shaped structural steel strips 68 and structural plastic 46.

Gap 72 lowers the thermal transmittance of the frame including generally normal to the length of the gap and therefore generally normal to the length of the frame. Complete encapsulation of strips 68 in structural plastic further contributes to lowering the thermal transmittance and adds strength to the frame.

Frame 60 is preferably made by continuous extrusion of the plastic structural element over the strips.

Sources for making frame 60 to specifications in accordance with the present invention by adjustment of the source's processes are available. For example, Kingston-Warren Company, Composite Technology Division 11/1986 bulletin THE DESIGN ENGINEER'S GUIDE TO POLYMER/METAL COMPOSITES offers a service of manufacturing elements constructed of plastic over metal by non-adhesive bonding.

In the process, as it is described, progressive roller dies shape a continuous metal strip. The polymer (rubber, synthetic, or blend) is extruded onto the passing metal. It is bonded and cured in the same production line, which might also include operations such as cutting, notching, punching, or coating. The product leaves the line in net or near-net shape. Two or more polymer sections may be permanently joined by cross heading and multiple extrusion lines.

Figure 8:
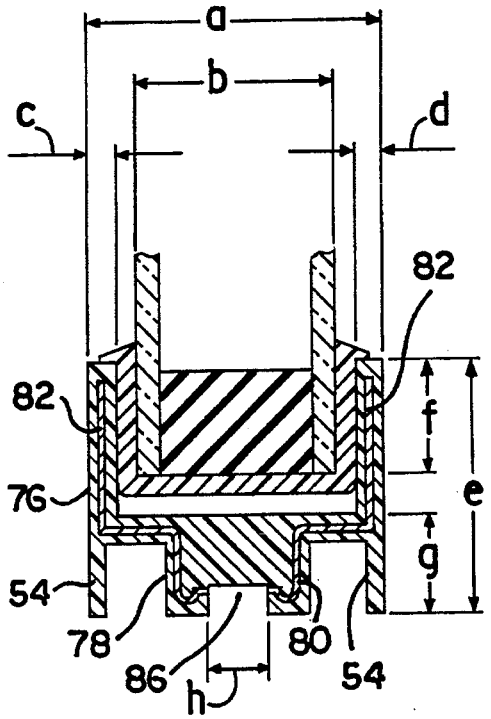

Frame 76, FIG. 8, is stronger than frame 60 and has a lower thermal transmittance.

Rearwardly depending leg 78 of structural plastic, which is wider than rearwardly depending legs 54, and second stage, rearwardly displaced J-shaped portions 80 of first stage steel L-strips 82 increase overall resistance to twist and bend of the frame.

Gap or notch 86 is preferably made by continuous saw cut as or after composite frame 76 leaves the extrusion die. Gap 86 may also be made during the extrusion process, such as in a modification of frame 60 of FIG. 7. This avoids baring the edges of L strips 82 by a saw cut.

Referring to FIG. 9, frame 88 features a wider gap between metal strips. This provides a lower thermal transmittance for the frame which obtains its strength and stiffness from the plastic, and resistance to bending from the metal.

Referring to FIG. 10, frame 90 has greater resistance to twist and bend forces than does frame 60 shown in FIG. 7. This is because steel U-channel element 96 has continuity across strip 104 between forward channel legs 100. Although 80% of the metal is removed in strip 104 to reduce thermal flow between its legs including therefore generally normal to the length of the length of frame 90, the remaining 20% is in the form of grid 200 for strength and rigidity. Grid 200 may be seen in FIG. 12.

Full benefit of the combined strength of structural plastic 46 and metal 96 is obtained by assuring the mechanical bond relationship between the plastic and the metal. Differences in thermal expansion and bending can apply disruptive forces to the bond. This is overcome by passage of the plastic through openings 204 in grid 200 so that it conforms to the cavities therein. Preferably extrusion parameters are set to assure that plastic passing though openings 204 from one side of U-channel element 96 fuses with plastic that it meets from the other side of 96.

In frame 110, FIG. 11, bond between structural plastic 46 and steel U-channel element 114 in which the plastic passes through the metal element incorporates all of element 114 which is a mesh. In this arrangement the rigidity of frame 110 can be closely controlled to a predetermined specification while reasonable strength and resistance to bending is maintained, with low thermal transmittance and cost.

Figure 13:
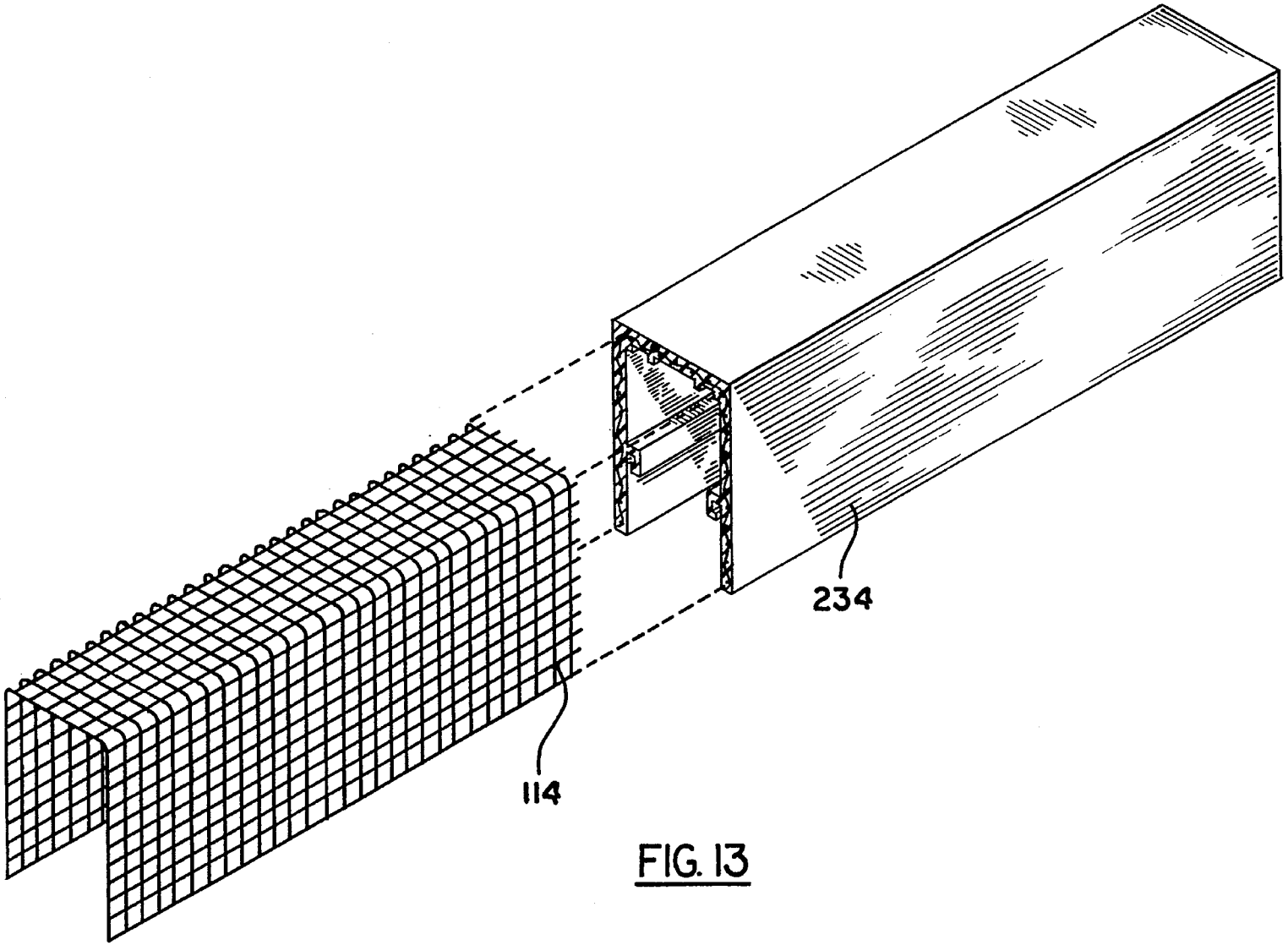

Preferably rigidity and strength is mostly controlled by the plastic, while resistance to bending is controlled by the mesh having a discrete structural shape as may be seen in FIG. 13. This is different from Fiberglass layered buildup construction.

For a lower U value, the mesh is made from stretch-resistant plastic rod, or natural or synthetic fiber.

As with the formed metal elements shown in FIGS. 5–10, the mesh element may be molded with the plastic into a continuous frame component by a plastic extrusion process.

Figure 12:
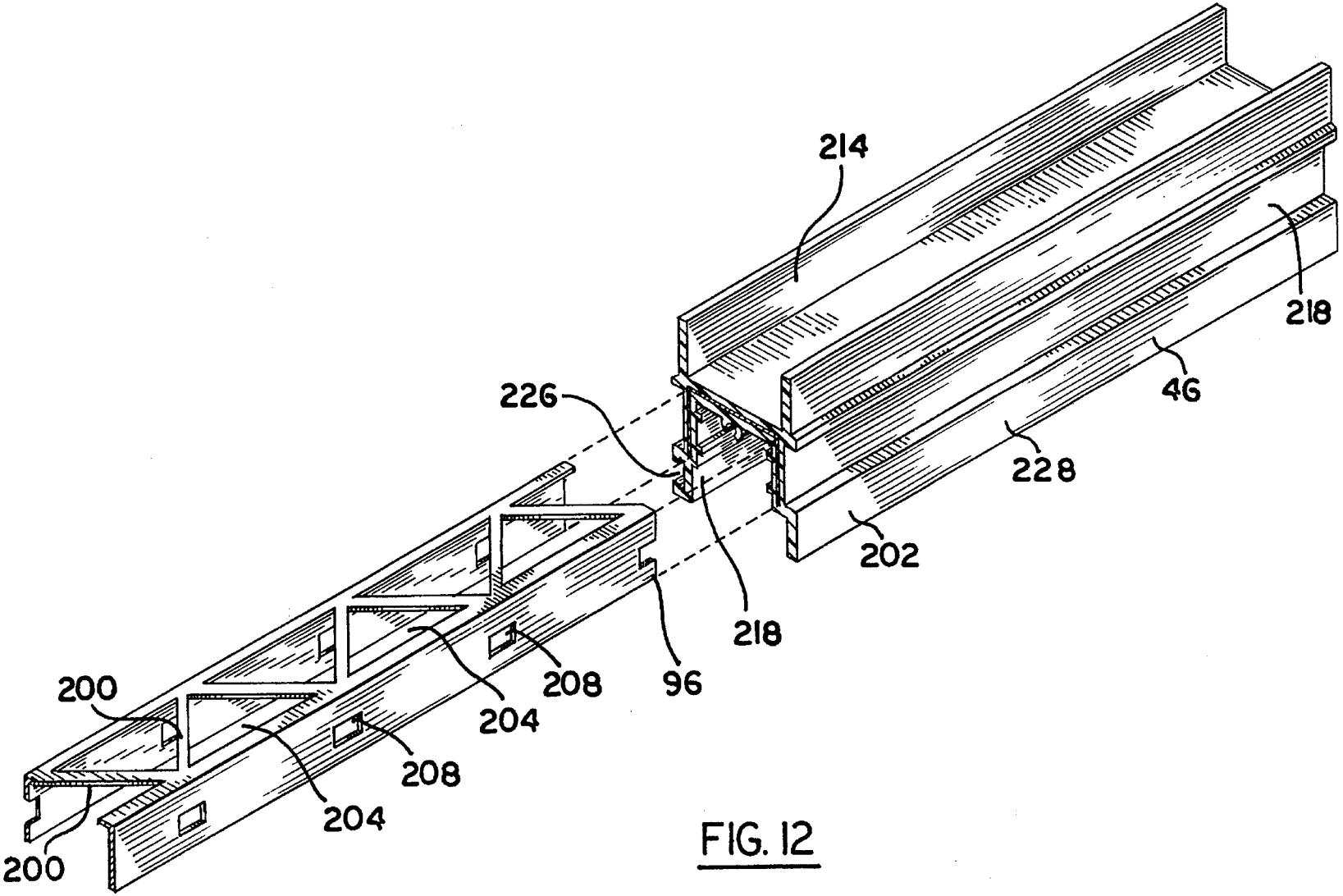
FIGS. 12–21 are further examples of constructions according to the present invention.

FIG. 12 shows frame 202 with grid 200 and openings 204 in the grid for receiving structural plastic 46 as described earlier with respect to FIG. 10. Rectangular openings 208 further contribute to the bond between the plastic and metal. A plurality of the openings are enclosed within the wall.

Rearwardly depending structural plastic legs 214 resist bending of frame 202. Forward channel legs 218 include specialized structural plastic extensions comprising an outward facing, longitudinal slot 226 along one extension, and a longitudinal L-shaped strip 228 along the other extension.

FIG. 13 shows a mesh, steel U-channel 114 as discussed earlier for FIG. 11, and a simple, U-shaped frame 234 with which it is extruded.

Figure 14:
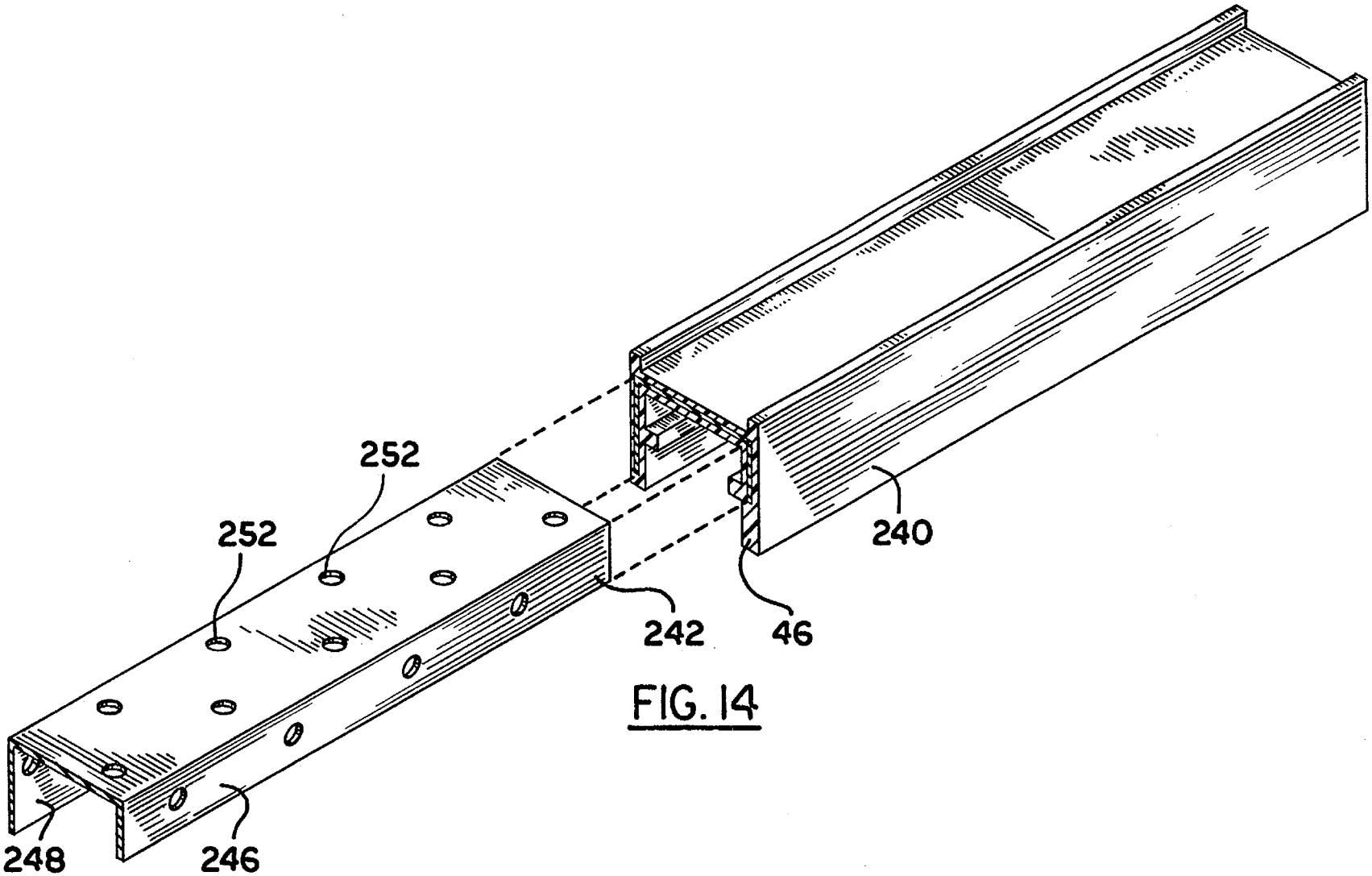

U-shaped frame 240, FIG. 14, includes J-shaped channel element 242, having leg 246 shorter than leg 248. Round openings 252 through element 242 assure a strong frame due to secure bond between structural plastic 46 and element 242.

Figure 15:
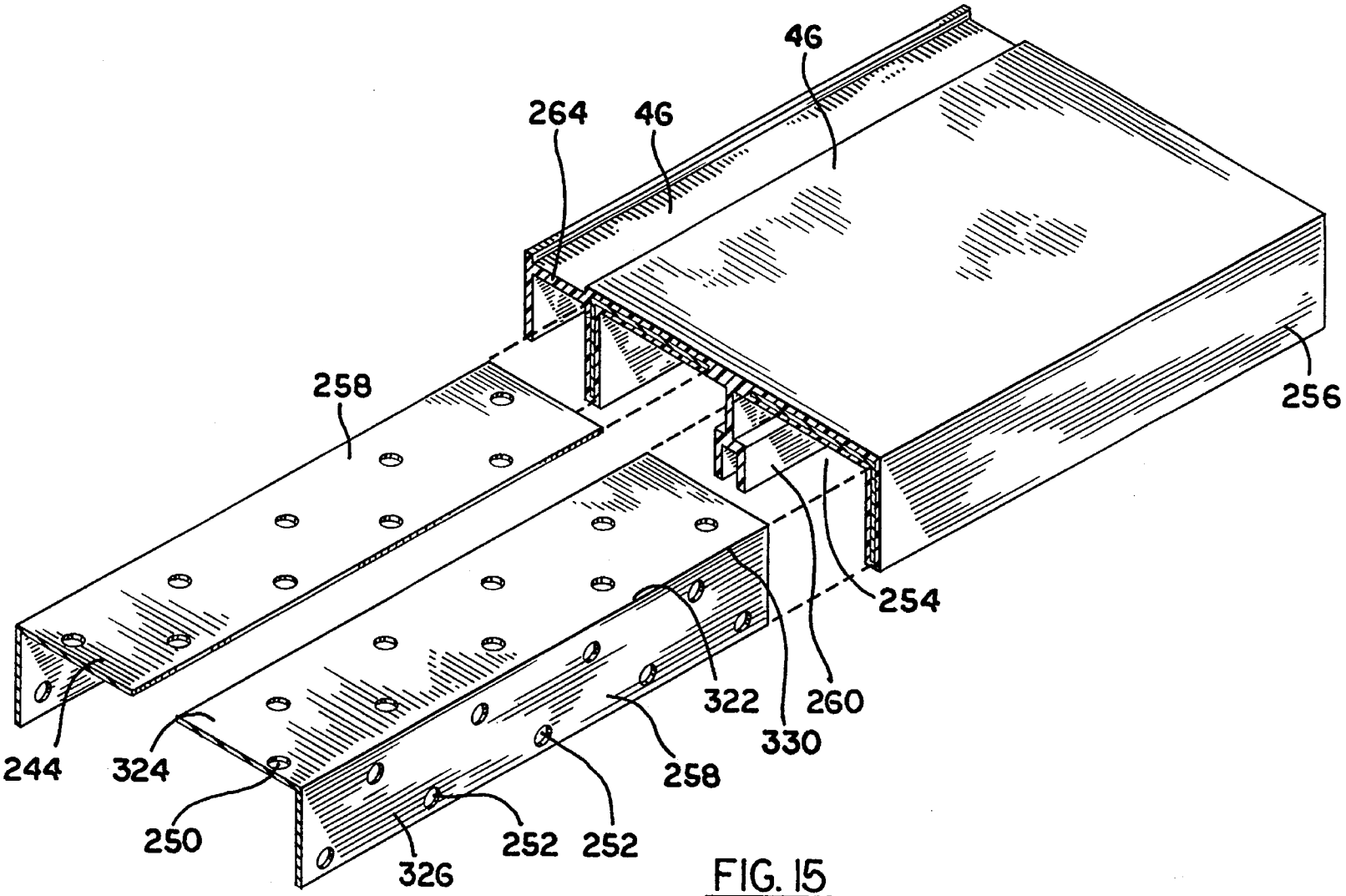

In FIG. 15, frame 256 includes channel 254 which comprises parallel L-shaped structural steel strips as described for FIG. 7. Walls 324 and 326 have round openings 250 and respectively with round openings 252 for structural bond with plastic 46. Side 330 of wall 324 is connected to side 332 of wall 326. Wall 244 is spaced parallel from wall 324. As shown, for example in the grid 200 wall in FIG. 12 and wall 324 in FIG. 15, at least one edge of the wall has a substantially unbroken edge which further contributes to rigidity of the element.

Frame 256 is molded in one continuous unitary form which includes channel 254 with plastic channel 260, plastic L strip 264, and L-shaped steel strips 258.

Figure 16:
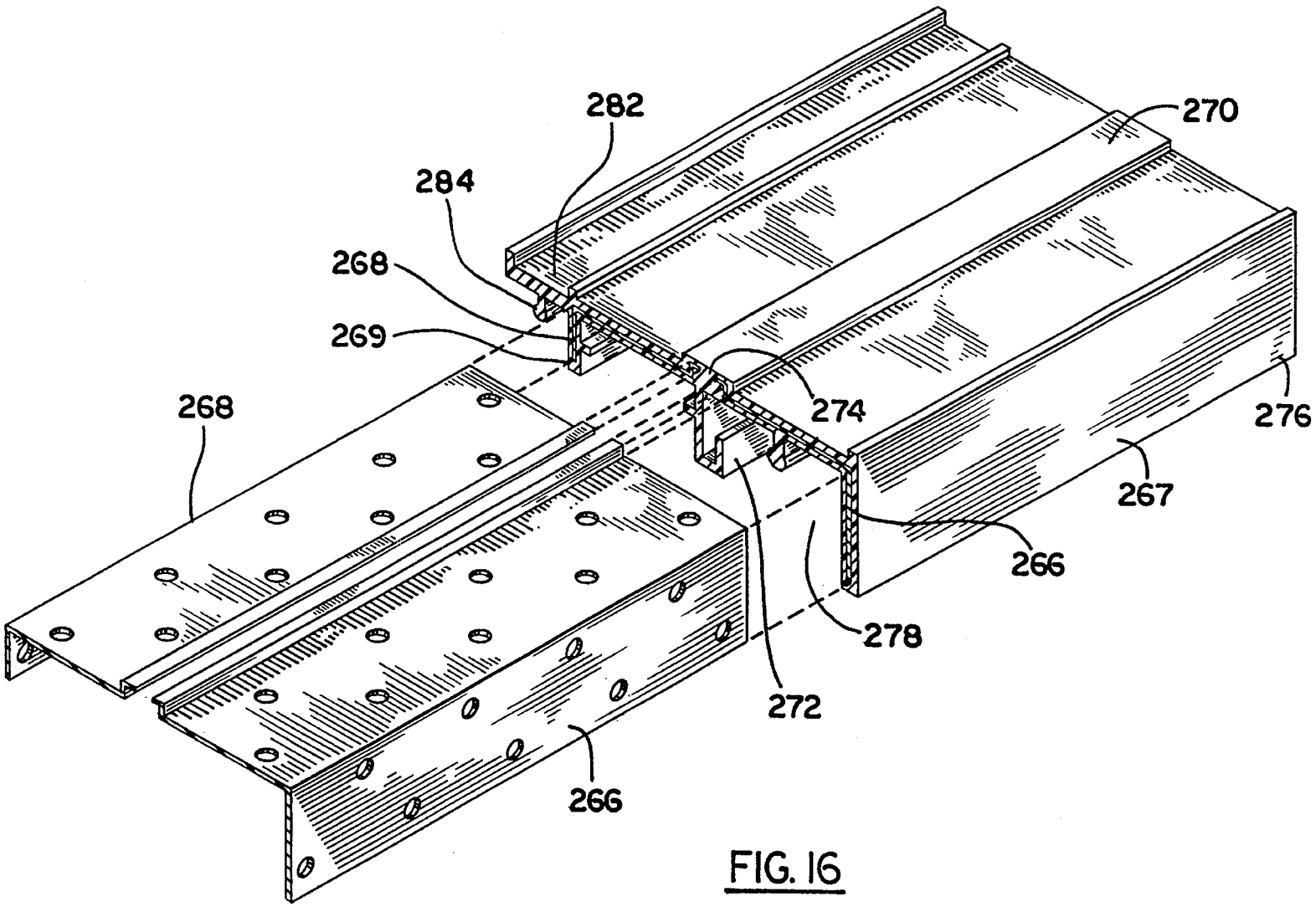

Referring to FIG. 16, the steel L strips 266 and 268 and rearwardly depending leg 270, with gap 274 of frame 276 are similar to the strip 82, leg 78, and gap 86 arrangement shown and described for frame 76 of FIG. 8. J-shaped forward leg 272 is molded within U-channel 278 about the location of gap 274. Strip 282, extending laterally from leg 269, the shorter of the two legs 267 and 269, and containing forward guide rail 284,is also integrally molded with frame 276.

As shown, for example, in FIGS. 12, 13, 14, 15, 16, and 17, there is a plurality of openings through a first wall of the frame member that are exclusive of a second wall of the frame member. That is, each of the plurality of openings does not extend into a wall that is connected directly or by an intermediated wall, to the first wall.

Figure 17:
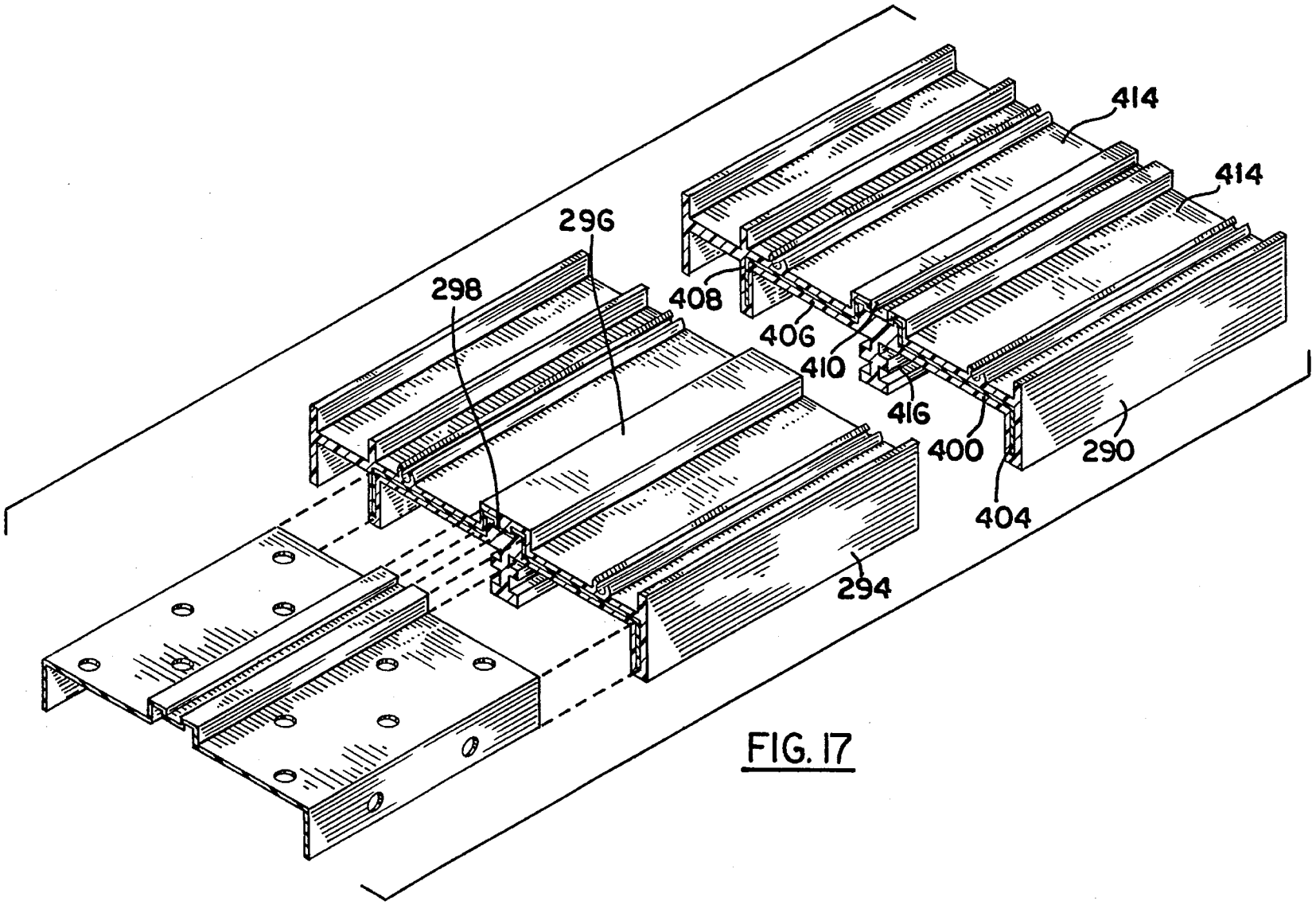

FIG. 17 shows frame 290 made from frame 294 which was extruded as a unitary item, by sawing down through rearwardly depending leg 296 just through steel U-channel element 298, similarly to the way that gap 86 was made in frame 76 shown in FIG. 8. Wall 400–404 are separated and spaced apart between walls 400 and 406, and there is a continuous notch 410 in plastic 414. Plastic wall 416 extends forward.

Figure 18:
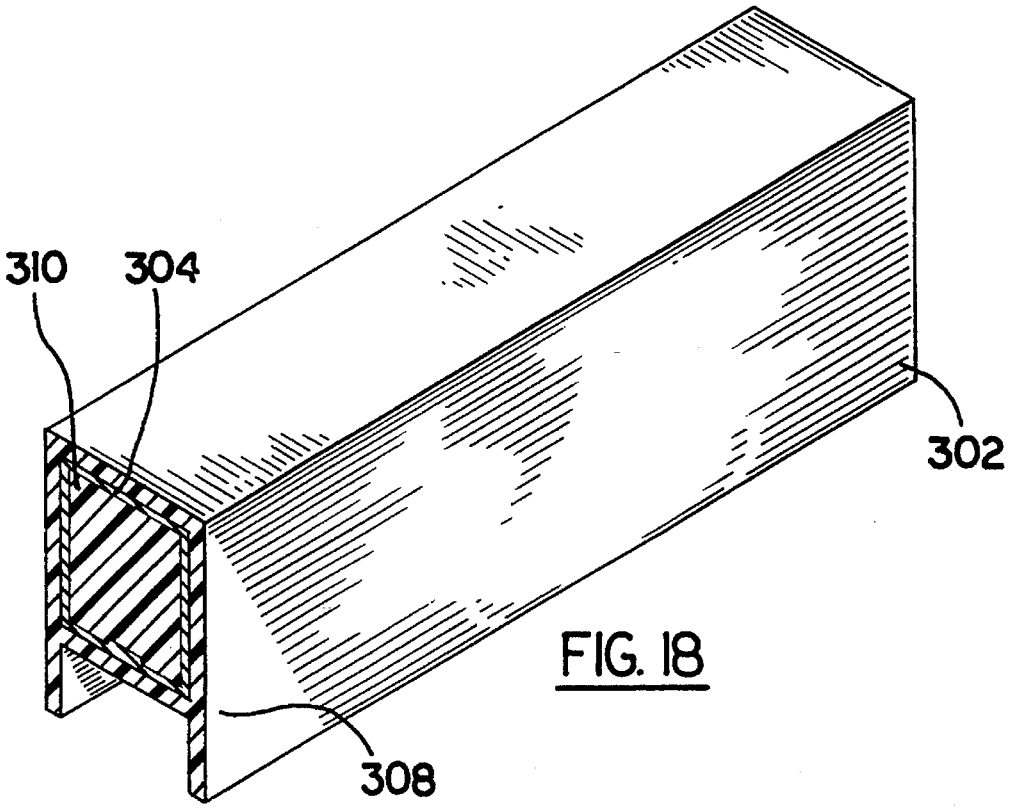

Frame 302, shown in FIG. 18, includes two structural plastics with metal box-beam 304. Plastic 308 provides stiffness and support in a required configuration, while plastic 310 and box beam 304 provide resistance to twist and bending.

Figure 19:
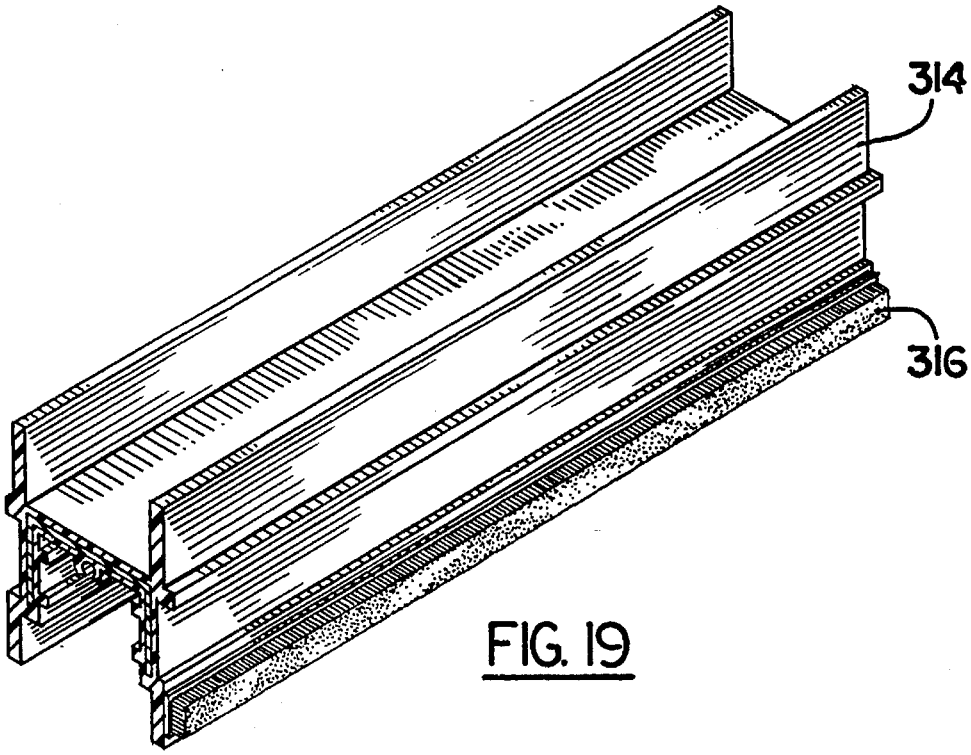

Frame 314, shown in FIG. 19 includes continuously attached weatherseal 316.

Figure 20:
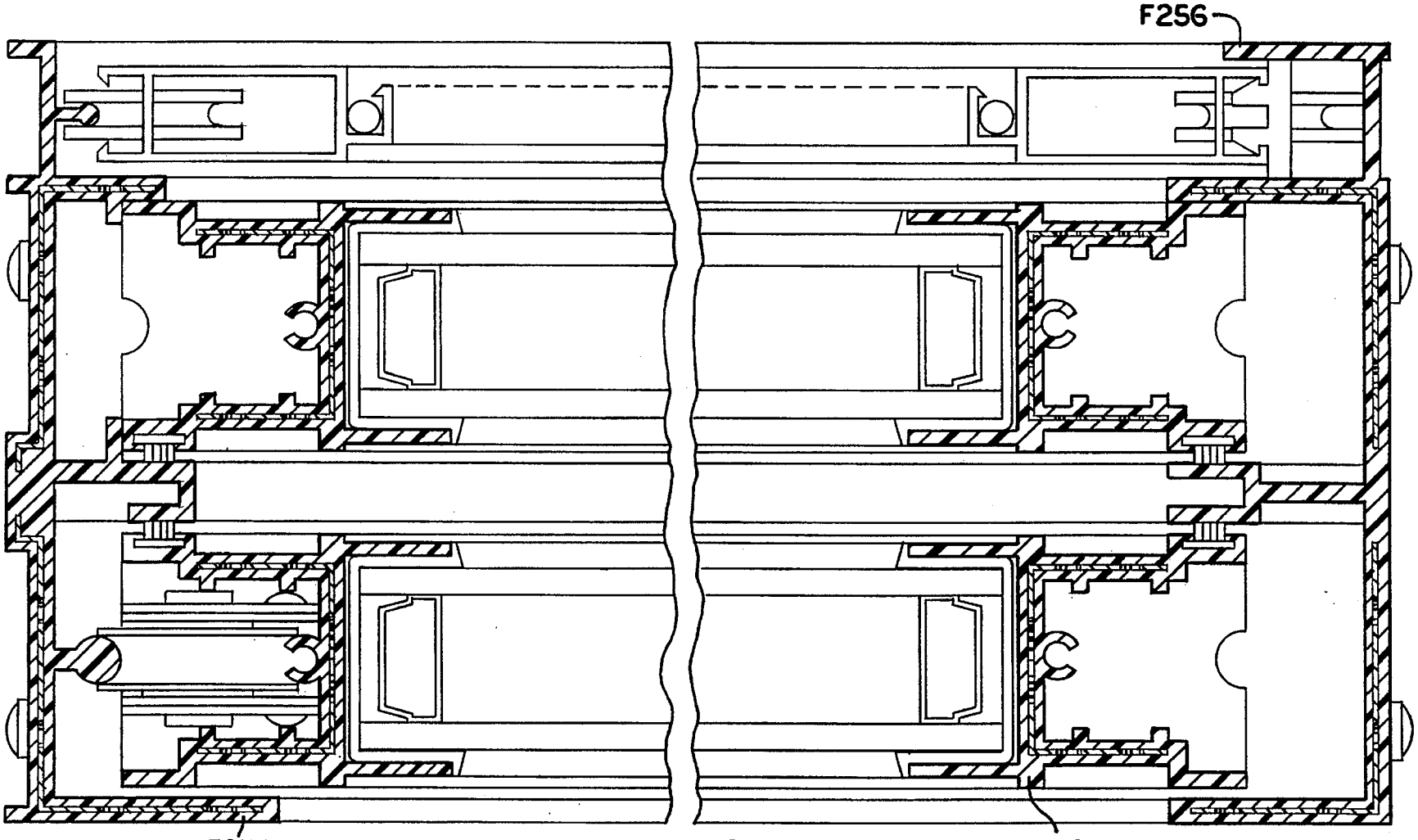
Figure 21:
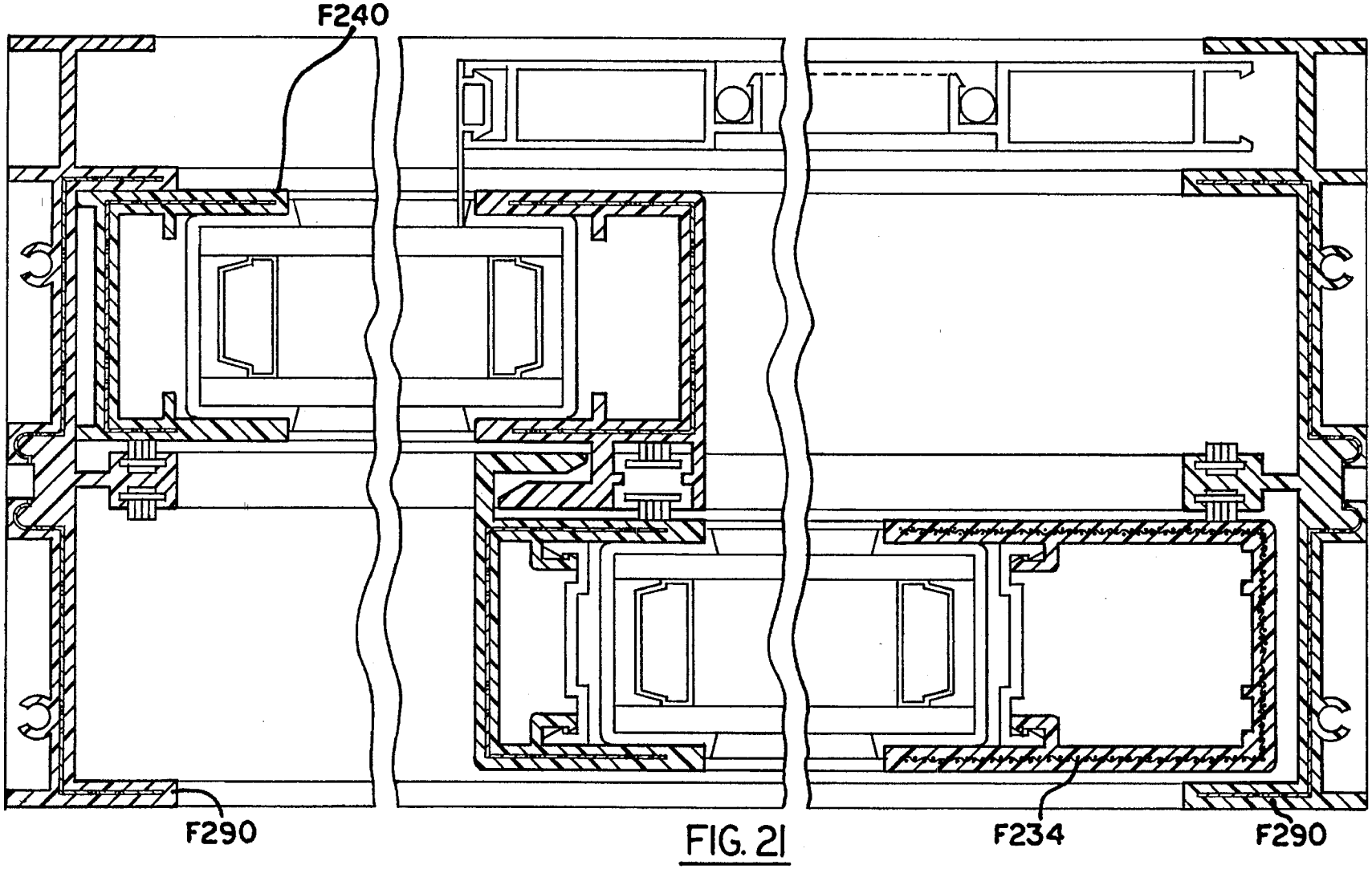

Various applications of the frames shown in FIGS. 5 through 19 may be seen in the sliding glass door assembly examples in FIGS. 20 and 21. They are designated by "F" followed by the number of a frame having similar features.

Although examples of sliding glass door framing members are shown, it should be understood that the present invention is applicable to window and other frame assemblies.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. In an improved inflexible frame member of predetermined shape, for windows, doors or the like, said frame member comprising:

a first element having a length, at least one surface, and being substantially non-hollow in transverse cross section said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall (324, 440) substantially the length of said first element, and a second wall (326, 404), said first wall having a first side, a front and a back, and said second wall having a first side, a front and a back, said second wall being connected on its first side to the first side of said first wall in a substantially continuous joining, substantially along the length of said first wall, and angled from the plane of said first wall, a first plurality of openings through said first wall, enclosed within said first wall, and exclusive of said second wall, said second element being molded to itself from the front to the back of said first wall though said first plurality of openings, the improvement comprising said first plurality of openings comprising a triangular pattern grid (104, 200 FIGS. 10 and 12) for reduction in transverse thermal flow and for strength and rigidity against transverse bending of said frame, in which said openings occupy no less than 70% of the area of said grid.

2. In an improved inflexible substantially straight; structural frame member of predetermined shape, for windows, doors or the like assemblies, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall (324, 400) substantially the length of said first element, and a second wall (326, 404), said first wall having a first side, a front and a back, and said second wall having a first side, a front and a back, said second wall being connected on its first side to the first side of said first wall in a substantially continuous joining, substantially along the length of said first wall, and angled from the plane of said first wall, a first plurality of openings through said first wall, enclosed within said first wall, and exclusive of said second wall, said second element being molded to itself from the front to the back of said first wall through said first plurality of openings, the improvement comprising said first element further being discontinuous normal to the length in that it comprises a third wall (244, 406) being essentially separate from said first and second walls, and having a first side spaced-apart from said first wall and generally parallel with said first side of said first wall substantially along the length of said first wall, as parallel strips (244/324, 406/400).

3. The frame member described in claim 2, further comprising:

said parallel strips comprising in cross section, a broken U, the break (274) in said U extending longitudinally substantially the length of said frame member, said first element and said parallel strips, and comprising the space between the parallel strips.

4. The frame member described in claim 2, further comprising:

said space between the parallel strips comprising a continuous notch (410) into said second element, said notch continuing substantially the length of said parallel strips.

5. The frame member described in claim 4, further comprising:

said second element comprising a fourth wall (416) composed essentially of said second element, on a side of said second element that is below said notch, said fourth wall extending away from said notch and along a substantially length of said parallel strips.

* * * * *